United States Patent [19]

Hewinson et al.

[11] 4,146,188

[45] Mar. 27, 1979

[54] METHOD AND APPARATUS FOR FORMING A FIBROUS CYLINDRICAL ELEMENT

[75] Inventors: Vincent K. Hewinson; Richard Barlow, both of Boston, England

[73] Assignee: E. Fogarty & Company Limited, Lincolnshire, England

[21] Appl. No.: 847,160

[22] Filed: Oct. 31, 1977

[51] Int. Cl.[2] ..... B65H 17/14

[52] U.S. Cl. ..... 242/67.1 R; 100/87; 242/75.1

[58] Field of Search ..... 242/67.1 R, 67.5, 65, 242/66, 75.1, DIG. 3, 68.7, 78.7; 100/87, 88

[56] References Cited

U.S. PATENT DOCUMENTS

| | | | |
|---|---|---|---|
| 660,243 | 10/1900 | Bessonette | 100/88 |
| 1,772,164 | 8/1930 | Taft | 100/87 |
| 2,778,759 | 1/1957 | Stephens et al. | 138/156 |
| 2,880,943 | 4/1959 | Stephens | 242/67.1 R |
| 3,501,106 | 3/1970 | Case | 242/67.1 R |
| 3,604,649 | 9/1971 | Dorfel | 242/66 |
| 4,063,693 | 12/1977 | Achelpohl | 242/67.1 R |

*Primary Examiner*—Stanley N. Gilreath

*Assistant Examiner*—John M. Jillions

*Attorney, Agent, or Firm*—Scrivener, Parker, Scrivener & Clarke

[57] ABSTRACT

Apparatus for forming a cylindrical element from a fibrous web, the element having a predetermined density characteristic radially thereof, comprises an endless belt, guide means about which said belt is entrained and which are arranged to define a loop in said belt to which loop the fibrous web is fed, said guide means being arranged so that, in use, said loop extends around substantially the entire circumference of the element forming in said loop, means for driving said belt so as to thereby cause the fibrous web to be fed into said loop and there to roll up on itself, and means for progressively increasing the diameter of said loop, said loop diameter increasing means including a control member about which said belt is entrained and which is movable to vary the dimensions of said loop, and means for moving said control member so as to increase the diameter of said loop at a rate which is a function of the linear speed of the belt and the length and weight per unit length of the fibrous web so as to obtain the predetermined radial density characteristic of the cylindrical element to be formed in said loop.

34 Claims, 6 Drawing Figures

METHOD AND APPARATUS FOR FORMING A FIBROUS CYLINDRICAL ELEMENT

Figure 1:
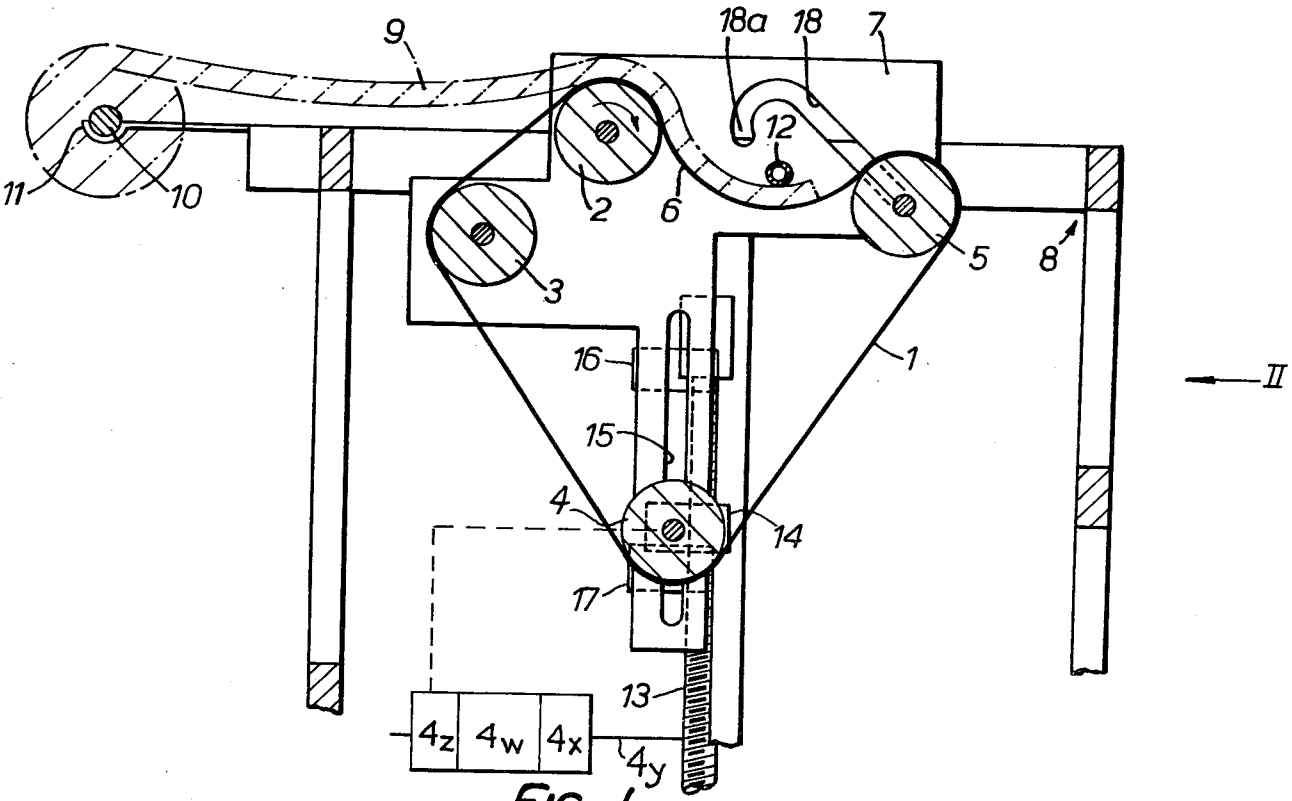

The present invention is concerned with a method and apparatus for forming a fibrous cylindrical element.

It is known to make fibrous cylindrical elements from a web of fibrous material in apparatus which comprises an endless belt, guide means about which the belt is entrained and which are arranged to define a loop in the belt to which loop the fibrous web is fed, and means for driving the belt so as to thereby cause the fibrous web to be fed into the loop and there to roll up on itself. In such apparatus the belt is entrained round a further guide means which is biased in a direction to tension the belt but is movable against the bias to permit the loop to increase in diameter as the web is fed into it. With such an arrangement the average radial density of the cylindrical element is determined by the biassing force and the actual density at any one point varies radially in a generally uncontrolled manner. It is not possible to positively control the density, for example to provide a constant density throughout radially of the element, nor is it possible to control the final diameter of the element.

It is an object of the invention to provide apparatus and a method of making a fibrous cylindrical element by which the radial density characteristic and the final diameter can be positively controlled and predetermined.

According to one aspect of the present invention there is provided apparatus for forming a cylindrical element having a predetermined density characteristic radially thereof of fibrous material from a web of fibrous material, the apparatus comprising:

an endless belt;

guide means about which said belt is entrained and which are arranged to define a loop in said belt to which loop the fibrous web is fed, said guide means being arranged so that, in use, said loop extends round substantially the entire circumference of the element forming in said loop;

means for driving said belt so as to thereby cause the fibrous web to be fed into said loop and there to roll up on itself; and means for progressively increasing the diameter of said loop, said loop diameter increasing means including a control member about which said belt is entrained and which is movable to vary the dimensions of said loop, and means for moving said control member so as to increase the diameter of said loop at a rate which is a function of the linear speed of the belt and the length and weight per unit length of the fibrous web so as to obtain the predetermined radial density characteristic of the cylindrical element to be formed in said loop.

According to another aspect of the present invention there is provided a method of forming a cylindrical element having a predetermined density characteristic radially thereof of fibrous material from a web of fibrous material, the method comprising:

feeding said web to a loop formed in an endless belt;

moving said belt to cause said web to roll up on itself in said loop; and increasing the diameter of said loop at a predetermined rate which is a function of the linear speed of the belt and of the length and weight per unit length of said fibrous web so as to provide a cylindrical element having the predetermined density characteristic radially thereof, said loop extending round substantially the entire circumference of said roll forming in said loop.

Advantageously the linear speed of the belt and the rate of increase of the diameter of the loop are together controlled as a function of the weight per unit length and length of the fibrous web to be fed into the loop so as to produce a cylindrical element having a predetermined diameter and constant density in the radial direction thereof.

If it is required that the fibres of the cylindrical element be bonded together, a bonding agent may be applied to the fibrous web during formation, after it is formed or it may be applied to the cylindrical element after formation and the bonding agent activated after formation of the cylindrical element.

The present invention will be more fully understood from the following description of embodiments thereof, given by way of example only with reference to the accompanying drawings.

Figure 2:
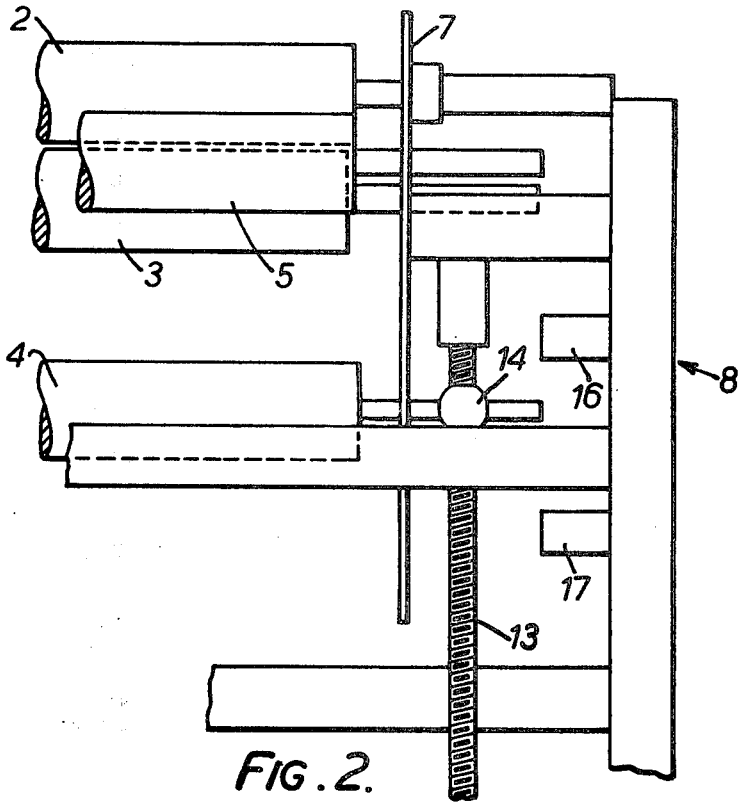
Figure 3:
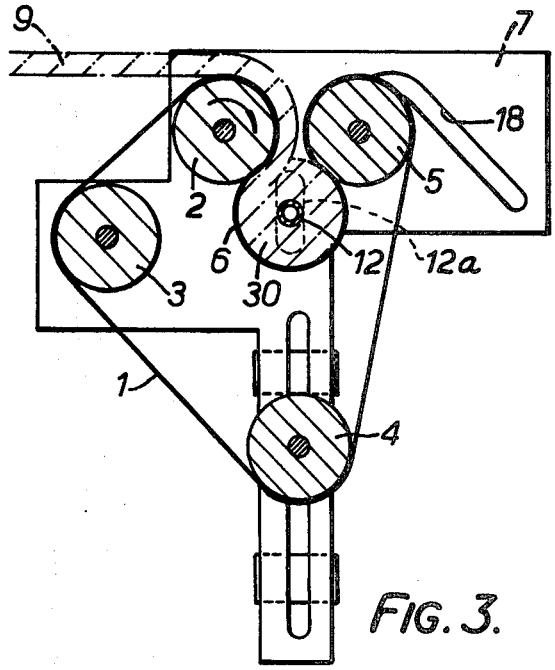
Figure 4:
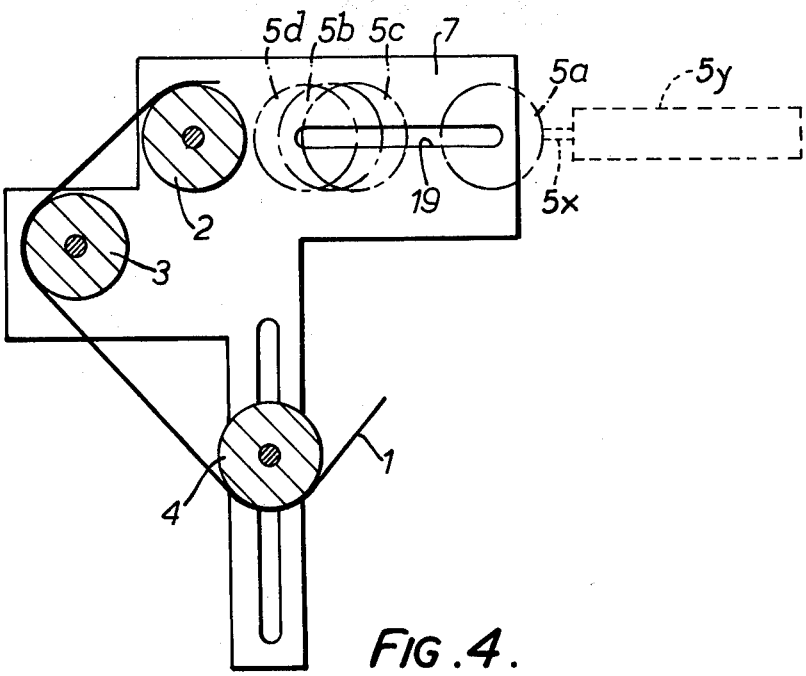
Figure 5:
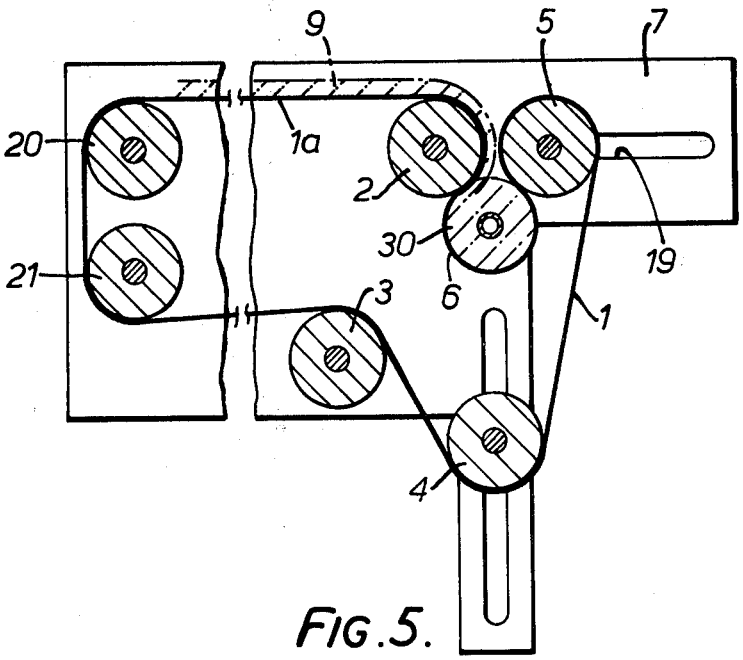
Figure 6:
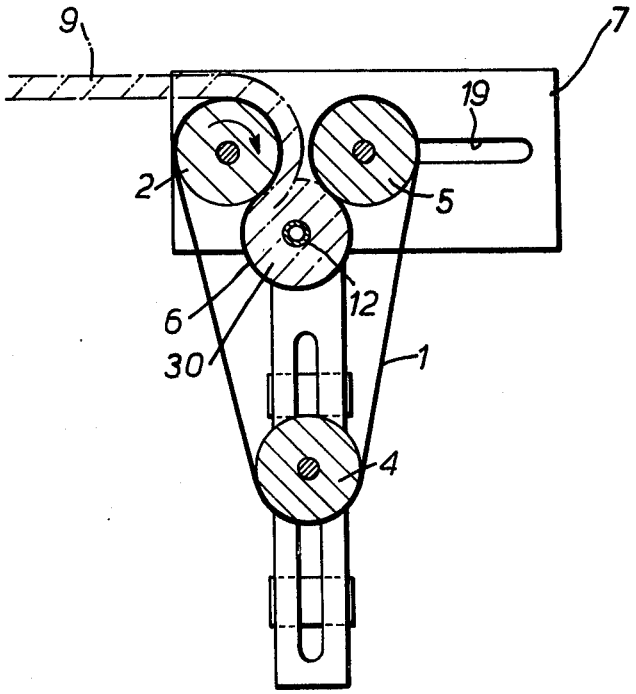

In the drawings:

FIG. 1 is a diagrammatic sectional view through an embodiment of apparatus according to the present invention, FIG. 2 is a view in the direction of the arrow II in FIG. 1 of one side of the apparatus, FIG. 3 is a diagrammatic sectional view similar to that of FIG. 1 but showing the apparatus in its operative configuration, FIG. 4 is a diagrammatic sectional view similar to that of FIG. 3 showing an alternative embodiment of the apparatus according to the invention, and FIGS. 5 and 6 are diagrammatic sectional views similar to that of FIG. 3 showing other embodiments of the apparatus.

As shown in FIGS. 1–3, the apparatus comprises an endless conveyor belt 1, for example of reinforced PVC, which extends round four rollers 2, 3, 4 and 5. Rollers 3 to 5 are idler rollers and roller 2 is driven in the direction of the arrow by a motor (not shown) through reduction gearing and a belt or chain drive (not shown). Between rollers 2 and 5 the belt is formed into a loop 6 in which a cylindrical fibrous element is formed, the diameter of the loop being varied during operation of the apparatus by displacement of one of the rollers 3 and 4. As shown roller 4 is displaced. Roller 5 is also movable laterally so that the gap between rollers 2 and 5 can be varied between the position shown in FIG. 1 in which the roller 5 is in an inoperative position well spaced from roller 2, and that shown in FIG. 3 where the roller 5 is in its operative position and the gap between the rollers 2 and 5 is small.

The rollers 2 to 5 are rotatably supported at each end in end plates 7 fixed to a supporting framework 8 (shown in part).

In operation a predetermined length of a web 9 of fibres having a predetermined weight per unit length is rolled onto a support roll 10 which is then located adjacent the rollers 2 to 5 in supports 11 which extend from the framework 8 at each end of the roll 10. Alternatively a supply roll of the fibrous web could be supported adjacent the apparatus and predetermined lengths drawn from this supply roll.

The roller 5 is moved to its inoperative position and the leading edge of the web 9 is placed in the belt loop 6. A mandrel 12, e.g. a hollow cardboard cylinder, about which the web is to be rolled is placed on top of the leading edge of the web and the roller 5 is moved back to its operative position so that the mandrel 12 and leading edge of the web are closely engaged by the belt loop 6 for frictional rotation of the mandrel 12. The motor driving the roller 2 is actuated to drive the belt 1 and, through the belt, wind the web onto the mandrel.

Simultaneously with actuation of the motor driving roller 2, a drive means including a motor (not shown) is actuated which causes the roller 4 to be progressively raised to increase the diameter of the loop 6. The linear speed of the belt 1 and the rate of increase of the diameter of the loop 6 are simultaneously controlled in dependence on the length and weight per unit length of the web 9 to provide the cylindrical element with a predetermined diameter and density characteristic radially thereof.

As shown the roller 4 is moved upwardly by a motor 4*w* driving two rods 13 through reduction gearing 4*x* and belts shown diagrammatically by 4*y*, the shaft of the roller 4 being guided in slots 15 in the end plates 7. Each rod 13 is threaded into a non-rotatable support member 14 in which an end of roller 4 is supported. Initially the roller 4 is in a position contacting a lower limit switch 17, or the zero-set position of a digital counting device, which is positioned to provide an initial loop which is sufficiently small for there to be the required frictional engagement between the belt, mandrel and the leading edge of the web to start the winding up process. The roller 4 continues to move upwardly until it contacts an upper limit switch 16 or the pre-set position of the digital counting device which deactuates the motor. The upper limit switch 16 is positioned in dependence on the required diameter of the cylindrical element.

The belt 1 and roller 4 may be moved at constant linear speeds to produce a fibrous cylindrical element whose density progressively decreases radially outwardly of the element. If it is required to provide a cylindrical element having a constant density radially thereof, the decrease in radial density can be partly corrected if the diameter of the cylindrical element is relatively small, by completing the last stages of rolling up without an increase in the loop size so that there is a compaction of the cylindrical element during this last stage. This is not entirely satisfactory for small diameter elements and is not satisfactory for larger diameter cylindrical elements. Where a closer approximation to a constant radial density is required, the rate of increase of the loop diameter decreases as the radius of the loop increases, with a constant linear speed of belt 1, or the speed of belt 1 increases as the loop size increases, with a constant rate of increase in the loop size.

The former of the above two alternatives can be obtained by progressively decreasing the speed of the motor driving the rod 13. For example the motor circuit may include a rheostate 42 of which either the rheostat winding or its contact is mounted to move with the roller 4. With such an arrangement the rheostat will be arranged to provide a constantly decreasing rate of increase of loop diameter. Alternatively the winding of the rheostat may be designed to provide any desired variation in the speed of the motor and therefore in the rate of increase in the loop size to provide the desired radial density characteristic in the cylindrical element.

Alternatively the roller 4 may be mounted at the apex of a triangle of rods of which the base rod has a variable length e.g. it may take the form of a threaded rod rotated by a motor at a constant speed and in opposed threaded engagement with the lower ends of the other rods of the triangle.

Variation in the linear speed of the belt 1 may be obtained by providing a rheostat in the circuit of the motor driving roller 2, the contact of which is progressively moved relative to the winding to provide the required variation in the speed of belt 1. This arrangement could also be used to provide any desired radial density characteristic in the cylindrical element, by suitably designing the rheostat winding or the movement of the contact therealong.

The variable gap between the rollers 2 and 5 is, as shown, provided by movement of the shaft of roller 5 in identical slots 18 in each end plate 7. When the shaft roller 5 is at the outer end of the slot, the loop 6 is large enough to remove a formed cylindrical element from it. The inner ends of the slots are formed as vertical portions 18*a* into which the shaft drops to positively hold the roller in its operative position in which the gap is just large enough to allow the web 9 to pass into the loop without undue frictional interference from the part of the belt running out of the loop over roller 5.

With this arrangement it has been found that the final cylindrical element tends to be slightly pear shaped with the top of the pear centred on the gap because the cylindrical element bulges slightly into the gap. This bulging produces a slight density variation which may not be acceptable. To avoid this, in a modification as shown in FIG. 4 the shaft of the roller 5 is mounted on the piston 5*x* of a cylinder 5*y* (shown diagrammatically in dash lines) which is actuated to position the roller 5 in a number of pre-set positions relative to the roller 2. The shaft of the roller 5 may, as shown, run in slots 19 in end plates 7, which slots are, as shown, horizontal. Alternatively the slot may be inclined or arcuate and, when arcuate, may be approximately centred on the roller 4 so that the length of the belt between the rollers 4 and 5 in any position of the roller 4 is approximately constant regardless of the position of the roller along the slots 19. Alternatively the slots 19 may be omitted.

As shown, the cylinder and piston is actuated to move the roller from its inoperative position 5*a* at the outer ends of the slots 19 to an initial position 5*b* relatively close to the roller 2 to provide the initial maximum frictional drive to the mandrel to start the winding operation. Thereafter the roller is moved back to a position 5*c* slightly more spaced from the roller 2 (typically by a distance of between 5mm to 30mm, preferably 18mm) to avoid the above referred to interference between the incoming web and the outgoing belt. Finally when the web is completely fed into the loop, the roller is moved to a position 5*d* to substantially close the gap but avoiding frictional contact between the parts of the belt passing over rollers 2 and 5. With the roller 5 in this position and the belt running, the roller 4 is gradually raised by a small amount (typically 3 to 15mm for a final outside diameter of 50 to 175mm) over a short time (typically 1 to 4 minutes). During this period the rollers rotate at constant velocity. This operation increases fractionally the size of the loop so allowing the fibres to expand and occupy this additional space. Consequently built-in stress and strain patterns within the cylindrical element are re-distributed so ensuring a fully uniform element. An addition advantage is the resulting blurring of the interfaces between successive layers of the web within the cylindrical element derived from the re-distribution of fibres and a slight felting action which takes place between the web layers.

Because the belt runs in only one direction through the loop 6 it is found that the mandrel tends to be slightly displaced towards the roller 5 so that the cylindrical element is slightly eccentric. This movement of the mandrel may be corrected by providing vertical slots 12*a* (shown in dash lines in FIG. 3) in the end plates 7 in which the mandrel 12 is guided and moves as the loop increases in diameter, antifriction bearings being provided between the mandrel and the slots. Alternatively the mandrel may be engaged in such slots only in the final rolling stages.

During this last stage, after the winding up is complete, the cylindrical element may be encased in a protective sheath, e.g. of paper, which is fed into the loop in the same manner as the web. Alternatively the outer layer of fibres of the cylindrical element are bonded to provide the element with its own protective layer by blowing hot air into the gap between the rollers 2, 5 as the element is slowly rotated. The element can then be removed from the apparatus after movement of the roller 5 away from roller 2 by a distance slightly greater than the diameter of the element.

In a modification, shown in FIG. 5, similar to that of FIG. 4, the apparatus includes two further rollers 20, 21 which provide an input belt portion 1*a* along which the web 9 is fed to the loop from a supply roller. In a further modification, shown in FIG. 6, similar to the embodiment of the FIG. 4, the roller 3 of the embodiment of FIG. 4 has been omitted to simplify the construction. In this embodiment the speed of the motor driving the roller 4 upwards is progressively reduced, the speed of the belt being maintained constant. Advantageously, as described above, this speed reduction is obtained by coupling the roller 4 to the contact or slides of a potentiometer.

It will be appreciated that the supply of web to the apparatus may be, as above described, from a supply roll on which a predetermined length has been provided or from a roll of web of a longer length from which predetermined lengths are cut off, or the supply may be direct from the web making machine.

The fibrous web may be made in a number of conventional ways but must be made so as to have a substantially constant density in both longitudinal and transverse directions with a known fibre orientation.

For example the loose fibres may be distributed evenly across the width of a moving feed belt and may then be processed by a garnetting machine which provides a very thin web of fibres evenly distributed thereacross and therealong and with the fibres orientated generally in the length of the web. Thereafter this initial thin web may be deposited on a further conveyor so as to build it up into a thicker web comprising a number of layers of the thin web.

If a longitudinal fibre orientation is required, the initial thin web may be plated, i.e. built up into a thicker web by laying a number of layers of the thin web exactly one on top of the other. This method produces discrete lengths of web to be fed to the above described rolling apparatus. Alternatively the plating can be effected continuously with the layers overlapping but not entirely superimposed. With this arrangement care should be taken to ensure that there are the same number of layers of the thin web in the thicker web at each and every longitudinal point of the thicker web.

To provide a web in which the fibres are inclined to the longitudinal direction, the initial thin web may be crossfolded the angle of inclination depending on the relative feed speed of the thin web and the take-off speed of the final web. With crossfolding care must be taken that the zig zagging edges of the thin web at the faces of the final web are coincident but do not overlap or gap otherwise there would be provided a zig zag area of substantially increased or reduced weight per unit length of the web. Advantageously the edges of the initial thin web should be feathered before crossfolding so that potential irregularities in the density of the final crossfolded web arising from irregularities in these edges are substantially eliminated.

To provide a web in which the fibres are orientated substantially normal to the length of the web, the initial thin web may be gathered together and the resulting relatively narrow web laid back and forth across a moving conveyor.

Where the fibres of the cylindrical element are to be bonded together, the bonding agent may be applied to the fibres during formation of the web, after formation of the web and before formation of the cylindrical element, or after formation of the cylindrical element. Where the bonding agent is to be applied to the web during or after production, care must be taken that it is regularly dispersed throughout the thickness, length and breadth of the web. If the bonding agent is to be applied to the formed cylindrical element, the element may be dipped in the bonding agent or the bonding agent may be vapour deposited in the element by blowing a vapour carrying the bonding agent radially through the cylindrical element, the vapour condensing in the cylindrical element.

In a preferred embodiment the fibres are polyacrylonitrile fibres and the bonding agent is the latent solvent cyclic tetramethylene sulphone. This latent solvent is activated after the cylindrical element has been made by placing the cylindrical element on its mandrel in an oven through which hot air is blown evenly along the length of the cylinder. The cylinder is rotated in the oven to prevent any "set" of the fibres or any gravitational distortion occurring in the cross-section. If the cylinder is relatively long, it may additionally be supported on a slotted or perforated metal core which frictionally engages in, or is mechanically engaged with, the mandrel and prevents longitudinal sag of the cylindrical element intermediate its ends. It is essential that an oven with total hot air exchange is employed to ensure the removal from the cylindrical element of all latent solvent vapour. After a short time in the oven, approximately 2 minutes, the outside fibres of the cylinder are bonded sufficiently to permit the removal of the constraining sheath if provided. The sheath is removed to ensure the maximum passage of hot air through the fibrous matrix and hence the removal of evaporated water, solvent or latent solvent, it further advantageously leads to substantially equal heating history of all individual fibre bonds within the cylinder.

The web fed to the above described rolling apparatus is preferably formed of between 3–12 layers of an initial thin web, advantageously between 4 and 7 layers, the web having been treated with the bonding agent during formation. The weight of the initial web is preferably between 10 and 30 grammes per square meter and therefore the weight of the web fed to the rolling apparatus is between 30 and 360 grammes per square meter. Preferably the weight of the web fed to the rolling apparatus is between 60 and 120 grammes per square meter. Alternatively as previously mentioned the rolling apparatus may be fed with the initial thin web and therefore the web fed to the apparatus may weigh as little as 10 grammes per square meter.

When the latent solvent bonding agent is employed preferably 8% to 50%, advantageously 15% to 30%, of solvent by weight of web is applied to the web and the temperature of the oven is between 120° C. and 130° C., the element being heated for up to 90 minutes.

Cylindrical elements having diameters of between 50mm and 500mm of which the central aperture is between 5mm and 75mm may be formed by the above described apparatus having densities of between 25 to 250kg per $m^3$. Such a cylindrical element may be up to 4m long, but is preferably between 1m and 2.5m long.

Depending on the eventual use of the cylindrical element, after the bonding agent has been activated, the cylindrical element may be cut to provide one or more shorter cylindrical elements, either manually with a knife or with a reciprocating blade or rotating cutter. The cylindrical element may also be externally machined to the required diameter using a rotary blade which cuts the surface of the element while the element is rotated. The blade is inclined to the radial plane of the cylindrical element and is rotated in a direction opposite to the direction of rotation of the cylindrical element.

It will be appreciated that there is an upper limit on the speed of rotation of a blade or cutter used to cut the cylindrical element which depends on the fibres used. If the speed is too high the fibres will fuse.

There is thus provided a method and apparatus for forming a cylindrical element of fibrous material which can have any predetermined density characteristic in the radial direction.

What is claimed is:

1. Apparatus for forming a cylindrical element having a predetermined density characteristic radially thereof of fibrous material from a web of fibrous material, the apparatus comprising:

an endless belt;

guide means about which said belt is entrained and which are arranged to define a loop in said belt to which loop the fibrous web is fed, said guide means being arranged so that, in use, said loop extends round substantially the entire circumference of the element forming in said loop;

means for driving said belt so as to thereby cause the fibrous web to be fed into said loop and there to roll up on itself; and means for progressively increasing the diameter of said loop, said loop diameter increasing means including a control member about which said belt is entrained and which is movable to vary the dimensions of said loop, and drive means separate from said belt for moving said control member so as to increase the diameter of said loop at a rate which is a function of the linear speed of the belt and the length and weight per unit length of the fibrous web so as to obtain the predetermined radial density characteristic of the cylindrical element to be formed in said loop.

2. Apparatus as claimed in claim 1, wherein said guide means comprise a pair of rollers arranged with their axis parallel, said loop extending between said pair of rollers, and said drive means is coupled to rotate that one of said pair of rollers at the input side of said loop.

3. Apparatus as claimed in claim 2, wherein said other one of said pair of rollers is movable in a direction transverse to its axis to vary the spacing between said pair of rollers.

4. Apparatus as claimed in claim 3, wherein said other roller is movable between a first inoperative position spaced from said one roller by a distance sufficient to enable a formed cylindrical element to be removed from said loop, and a second operative position adjacent said one roller but spaced therefrom at least by the thickness of the web.

5. Apparatus as claimed in claim 4, including guide means for guiding said other roller as it moves between its first and second positions.

6. Apparatus as claimed in claim 5, wherein said guide means are formed by at least one slot.

7. Apparatus as claimed in claim 6, wherein said slot includes a vertically extending part, the closed end of which defines said second position.

8. Apparatus as claimed in claim 4, including means for moving said other roller between said first and second positions thereof.

9. Apparatus as claimed in claim 8, wherein said moving means include a cylinder and piston.

10. Apparatus as claimed in claim 4, wherein said other roller is movable to a third position immediately adjacent but not contacting said one roller.

11. Apparatus as claimed in claim 1, wherein said control member is a control roller about which said belt is entrained and which is movable in a direction transverse to its axis.

12. Apparatus as claimed in claim 11, wherein said means for moving said control member includes a motor coupled to drive a threaded rod engaging a support member carrying said control member.

13. Apparatus as claimed in claim 1, wherein said means for moving said control member is operable to move said control member at a progressively decreasing rate.

14. Apparatus as claimed in claim 13, wherein said belt drive means is operable to drive said belt at a substantially constant rate.

15. Apparatus as claimed in claim 12, wherein said motor is operable through means for progressively varying the power supplied thereto.

16. Apparatus as claimed in claim 15, wherein said power varying means includes a rheostat, said rheostat winding and contact being relatively movable by said control member.

17. Apparatus as claimed in claim 1, wherein said means for moving said control member is operable to move said control member at a substantially constant rate.

18. Apparatus as claimed in claim 17, wherein said belt drive means is operable to drive the belt at a rate which is a function of the rate of increase in the diameter of the loop and the length and weight per unit length of the fibrous web.

19. Apparatus as claimed in claim 18, wherein said belt drive means is operable to drive the belt at a progressively increasing linear speed.

20. Apparatus as claimed in claim 1, wherein said belt is entrained round further guide rollers to provide a horizontal input section on said input side of said loop for supporting the fibrous web being fed into said loop.

21. Apparatus as claimed in claim 1, including a mandrel on which the fibrous web is wound in said belt loop.

22. Apparatus as claimed in claim 21, including means for guiding said mandrel as it moves with progressive increase in the diameter of said loop.

23. A method of forming a cylindrical element having a predetermined density characteristic radially thereof of fibrous material from a web of fibrous material, the method comprising:

feeding said web to a loop formed in an endless belt;

entraining said belt about a control member; mounting said control member for movement by a drive means separate from said belt;

moving said belt to cause said web to roll up on itself in said loop; and moving said control member by said drive means so as to increase the diameter of said loop at a predetermined rate which is a function of the linear speed of the belt and of the length and weight per unit length of said fibrous web so as to provide a cylindrical element having the predetermined density characteristic radially thereof, said loop extending round substantially the entire circumference of said roll forming in said loop.

24. A method as claimed in claim 23, including moving said control member so that said diameter of said loop increases at a substantially constant rate and moving said belt at a substantially constant linear speed.

25. A method as claimed in claim 23, including moving said control member and said belt so that the rate of change in the diameter of said loop and the rate of change of the linear speed of said belt are a function of the length and weight per unit length of the web so as to provide a cylindrical element whose density is substantially constant in the radial direction thereof.

26. A method as claimed in claim 25, including moving said belt at a substantially constant linear speed and moving said control member so that the diameter of said loop increases at a progressively decreasing rate.

27. A method as claimed in claim 25, including moving said control member so that the diameter of said loop increases at a constant rate and moving said belt at a progressively increasing linear speed.

28. A method as claimed in claim 23, including maintaining the diameter of said loop is maintained substantially constant while the trailing end portion of said web is fed into said loop.

29. A method as claimed in claim 23, including continuing to move said belt and increasing said loop diameter slightly after said web has been wound into said loop.

30. A method as claimed in claim 23, wherein the fibres in said web are orientated in the direction of the length of said web.

31. A method as claimed in claim 23, wherein the fibres in said web are orientated in directions inclined to the length of said web.

32. A method as claimed in claim 23, wherein said web is impregnated with a bonding agent and including activating said bonding agent to bond the fibres together after said cylindrical element has been formed.

33. A method as claimed in claim 32, wherein said fibres are polyacrylonitrile fibres and said bonding agent is cyclic tetramethylene sulphone which is activated by heat.

34. A method as claimed in claim 23, including winding said web in said loop on a mandrel to form an annular cylindrical element.

* * * * *